US006460814B1

(12) United States Patent
Bolick

(10) Patent No.: US 6,460,814 B1
(45) Date of Patent: Oct. 8, 2002

(54) SHOPPING BAG HOLDER

(76) Inventor: David Bolick, 540 Alcatraz Ave. #110, Oakland, CA (US) 94609

( * ) Notice: Subject to any disclaimer, the term of this patent is extended or adjusted under 35 U.S.C. 154(b) by 0 days.

(21) Appl. No.: 09/918,348

(22) Filed: Jul. 30, 2001

(51) Int. Cl.[7] ..... B65B 67/12
(52) U.S. Cl. ..... 248/95; 248/99
(58) Field of Search ..... 248/95, 97, 99, 248/100

(56) References Cited

U.S. PATENT DOCUMENTS 4,052,764 A * 10/1977 Groff ..... 15/257.9
4,407,474 A 10/1983 Swenson
4,437,634 A * 3/1984 Hambleton ..... 248/97
4,467,989 A * 8/1984 Stroh ..... 248/97
4,487,388 A * 12/1984 Provan ..... 248/97
4,669,689 A * 6/1987 Jones ..... 248/99
4,749,011 A * 6/1988 Rylander ..... 141/316
4,805,857 A * 2/1989 Travis ..... 248/97
D321,135 S * 10/1991 Bedell et al. ..... D9/434
6,042,063 A * 3/2000 Kerr et al. ..... 248/100
6,152,407 A 11/2000 McKenzie

* cited by examiner

*Primary Examiner*—Anita King
(74) *Attorney, Agent, or Firm*—Jack Lo

(57) ABSTRACT

The present shopping bag holder is for holding a used plastic or paper shopping bag as a garbage, trash, or recycling bag. It is comprised of a single side panel connected between opposite end panels to provide an open side. Semi-circular tabs project upward respectively from the tops of the end panels for holding the loop handles of a plastic shopping bag. A hole is provided in each tab for allowing a finger to pass under the loop handle to lift the bag. A gap is provided at the top of each tab to allow the finger to pass through. The side panel is angled outward for leaning a paper shopping bag inward and preventing it from falling out. The open side allows the shopping bag to expand when filled.

9 Claims, 3 Drawing Sheets

SHOPPING BAG HOLDER

BACKGROUND OF THE INVENTION

1. Field of the Invention

This invention relates generally to devices for holding up shopping bags as garbage, trash, or recycling bags.

2. Prior Art

Anyone who goes shopping frequently accumulates many plastic and paper shopping bags. The most common type of plastic shopping bag has large loop handles, and is usually given out at supermarkets and other stores. Many people reuse them as garbage bags by putting them in garbage cans. However, these shopping bags are too small for most home garbage cans. On a wide garbage can, the handles can usually still be stretched around the rim of the can. However, the can is too wide for the bag to be turned over the rim, so that garbage can fall between the bag and the can. On a narrow and tall garbage can, the bag can be turned over the rim, but the bag will fall into the can and expose the rim when garbage is thrown in. Some people also reuse stiff paper shopping bags, such as supermarket bags, but most home garbage cans are too small for them. Conventional garbage cans also restrict the bags and keep them from expanding to hold more garbage.

U.S. Pat. No. 4,407,474 to Swenson discloses a shopping bag holder. It is comprised of a three-sided box with tabs extending upward from the end panels. The tabs are smoothly flared into the edges of the end panels. The handles of the bag would tend to bind on the gentle slopes of the tall tabs before they are properly seated. There is also nothing on either side of the tabs to securely support the handles.

U.S. Pat. 6,152,407 to McKenzie discloses a shopping bag holder for reusing shopping bags as garbage bags. It is comprised of a U-shaped frame with tabs projecting upward from the ends of the frame for holding the loop handles of the bags. Gussets are arranged along the inside edges of the frame for strength. The square cornered tabs make installing the loop handles relatively difficult. Since the loop handles are stretched tight around the tabs, they are difficult to grab for removing the bag. The open sides of the holder also enable a paper bag to fall out when it is unevenly loaded.

OBJECTIVES OF THE INVENTION

The objectives of the present shopping bag holder are:

- to hold a used plastic shopping bag in an open position for receiving garbage, trash, or recycling;
- to hold a used paper shopping bag in an open position for receiving the same;
- to make installing a plastic bag easier;
- to allow the shopping bag to expand with garbage, trash, or recycling;
- to prevent a paper bag from falling out; and
- to make removing a plastic bag easier.

Further objectives of the present invention will become apparent from a consideration of the drawings and ensuing description.

BRIEF SUMMARY OF THE INVENTION

The present shopping bag holder is for holding a used plastic or paper shopping bag as a garbage, trash, or recycling bag. It is comprised of a single side panel connected between opposite end panels to provide an open side. Semi-circular tabs project upward respectively from the tops of the end panels for holding the loop handles of a plastic shopping bag. A hole is provided in each tab for allowing a finger to pass under the loop handle to lift the bag. A gap is provided at the top of each tab to allow the finger to pass through. The side panel is angled outward for leaning a paper shopping bag inward and preventing it from falling out. The open side allows the shopping bag to expand when filled.

DRAWING REFERENCE NUMERALS

10. Side Panel
11. End Panel
12. Open Side
13. Bottom Panel
14. Top Edge
15. Inner Edge
16. Outer Edge
17. Tab
18. Hole
19. Gap
20. Top
21. Outer Edge
22. Feet
23. Lip
24. Handle
25. Plastic Bag
26. Loop Handle
27. Paper Bag
28. Support Member

DETAILED DESCRIPTION OF THE INVENTION

Figure 1:
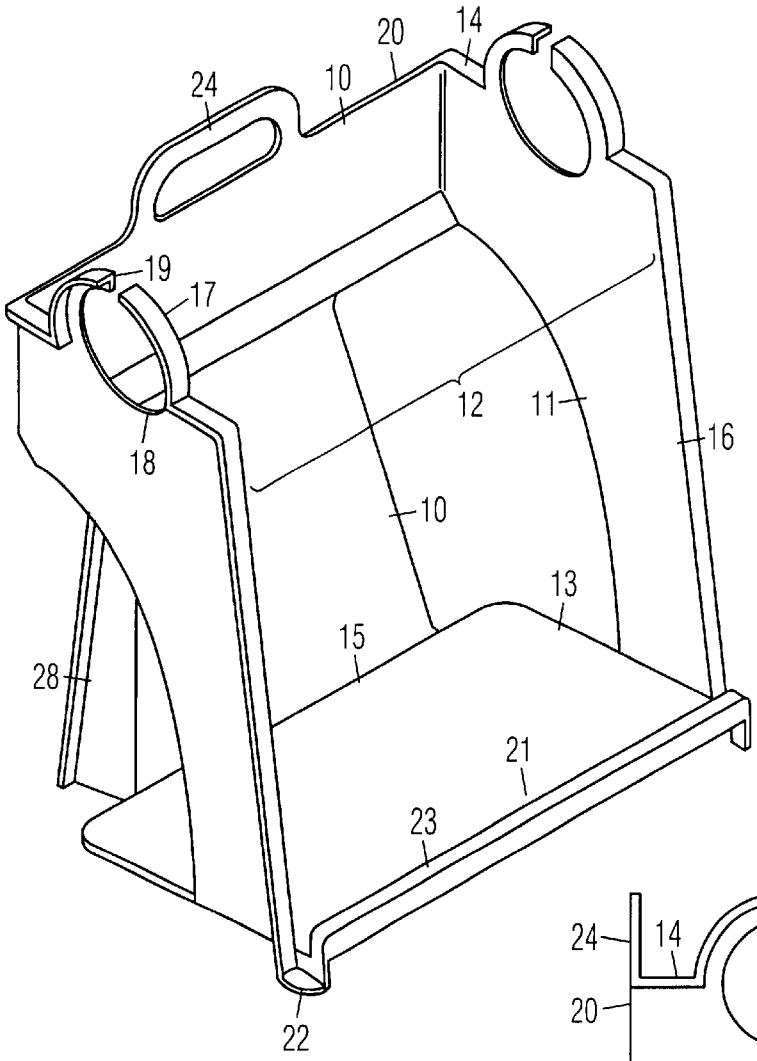
FIG. 1 is a side perspective view of the present shopping bag holder.
Figure 2:
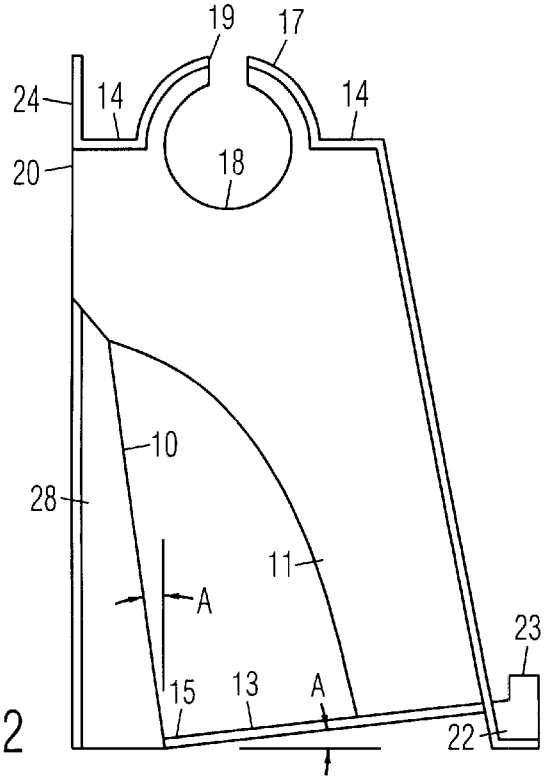
FIG. 2 is an end view thereof.

FIGS. 1–2:

A preferred embodiment of the present shopping bag holder is shown in a perspective view in FIG. 1 and an end view in FIG. 2. It is comprised of a single side panel 10 connected between opposite end panels 11 to provide an open side 12. A bottom panel 13 is connected between end panels 11. Side panel 10 extends horizontally between horizontal top edges 14 of end panels 11 and vertically down to an inner edge 15 of bottom panel 13. The interior of outer edges 16 of end panels 11 are substantially free of projections to maximize the width of open side 12. A semicircular circular tab 17 projects upward from top edge 14 of each end panel 11. A hole 18 is provided in each tab 17, and a gap 19 is provided at a midpoint of each tab 17. A top 20 of side panel 10 is angled outward relative to a bottom thereof, and an outer edge 21 of bottom panel 13 is angled upward by feet 22 underneath. Side panel 10 and bottom panel 13 are preferably tilted to an angle A of about 10 degrees, although they may be tilted more or less. A raised lip 23 is arranged along outer edge 21 of bottom panel 13. A handle 24 is attached to top 20 of side panel 10. A support member 28 is connected to side panel 10 and extend outwardly therefrom to prevent the holder from falling over due to the tilt in side panel 10. The bottom of support member 28 is aligned with inner edge 15 of bottom panel 13.

Figure 3:
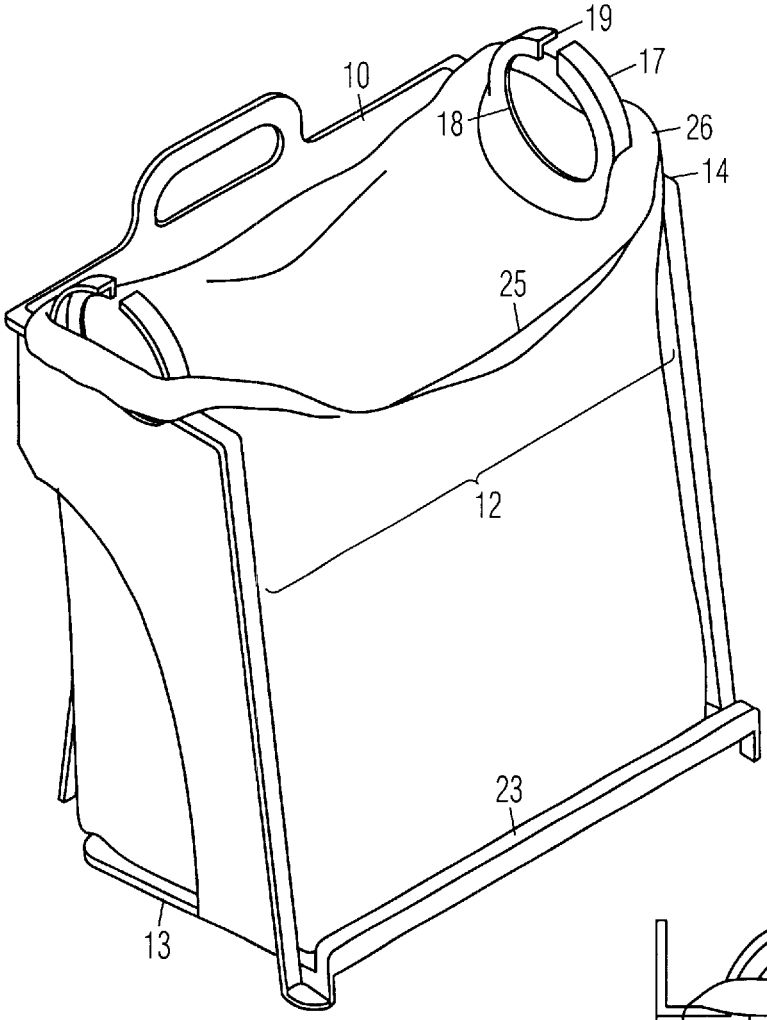
FIG. 3 is a side perspective view thereof when holding a plastic shopping bag.
Figure 4:
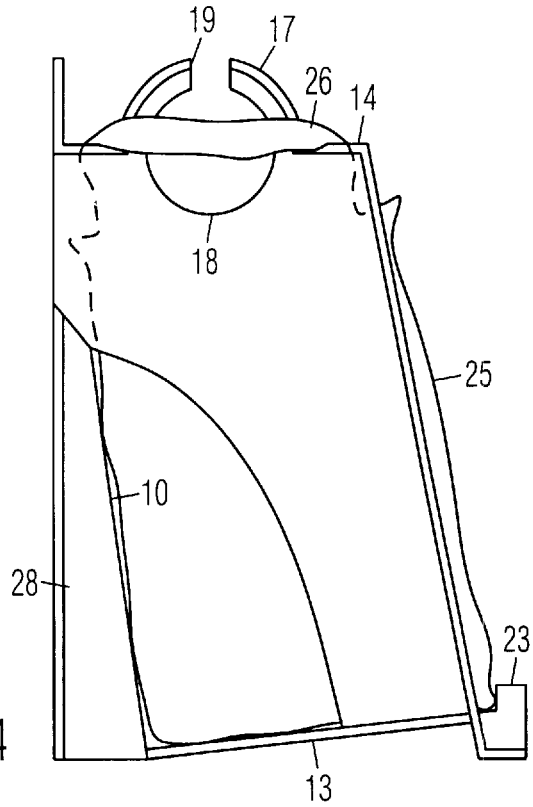
FIG. 4 is an end view thereof holding the plastic shopping bag.

FIGS. 3–4:

The shopping bag holder is shown in FIGS. 3 and 4 with a plastic shopping bag 25 installed. Bag 25 is held in an open position by wrapping each its loop handle 26 on a corresponding tab 17. Tabs 17 are perfectly semi-circular for enabling enable loop handles 26 to be easily placed over them. Horizontal top edges 14 of end panels 11 define orthogonal shoulders below tabs 17 to securely support handles 26 and prevent them from slipping down. Open side 12 enables bag 25 to expand when filled. Bag 25 is leaned toward side panel 10 to prevent it from falling out open side 12. Lip 23 on bottom panel 13 also helps retain bag 25 inside the holder.

Bag 25 may be removed by inserting fingers under loop handles 26 and through holes 18 in tabs 17, and lifting loop handles 26 by passing the fingers through gaps 19. Arched tabs 17 are shaped to avoid binding loop handles 26 and thus enable them to be more easily removed.

Figure 5:
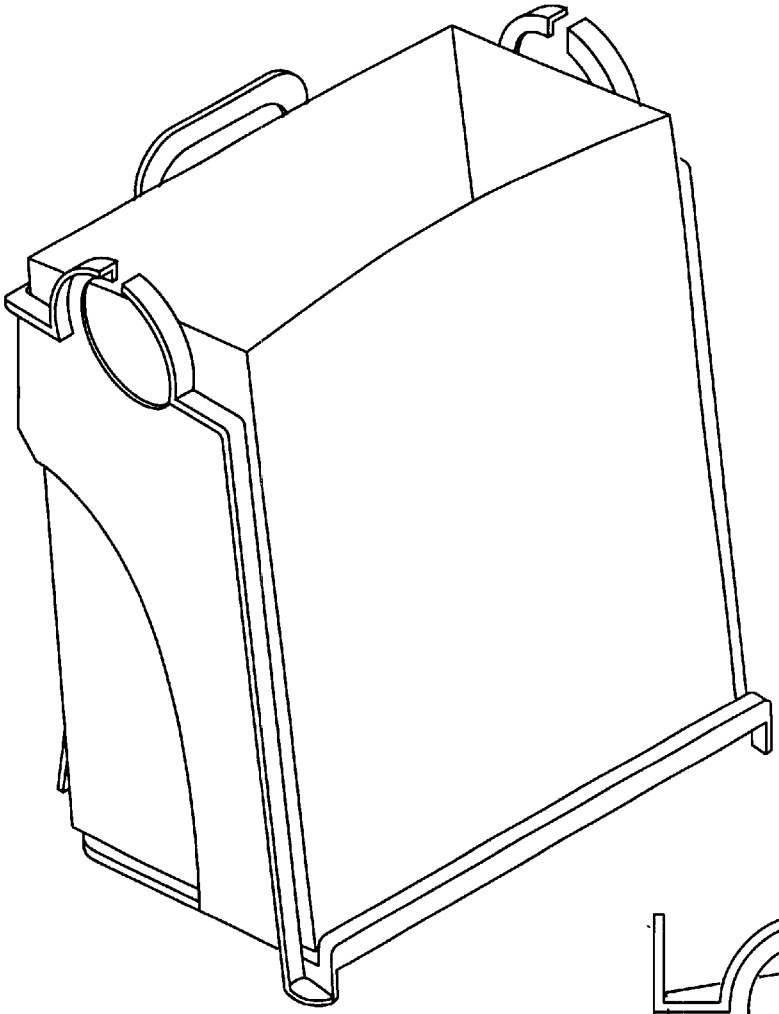
FIG. 5 is a side perspective view thereof when holding a paper shopping bag.
Figure 6:
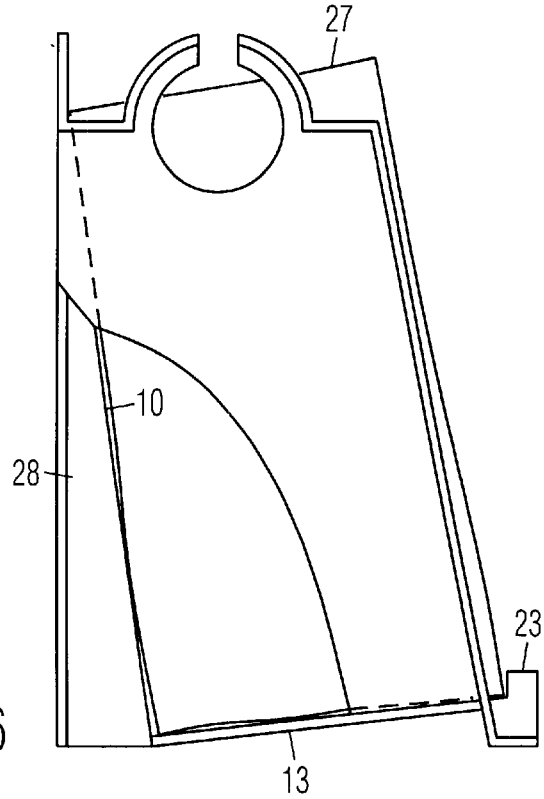
FIG. 6 is an end view thereof holding the paper shopping bag.

FIGS. 5–6:

The shopping bag holder is shown in FIGS. 5 and 6 with a paper shopping bag 27 installed. Open side 12 enables bag 27 to expand when filled. Bag 27 is leaned toward side panel 10 to prevent it from falling out open side 12. Lip 23 on bottom panel 13 also helps retain bag 27 inside the holder. Leaning paper bag 27 against side panel 10 is particularly important since it has no loop handles to attach to tabs 17.

SUMMARY AND SCOPE

Accordingly, the present shopping bag holder is arranged to hold a used plastic or paper shopping bag in an open position for receiving garbage, trash, or recycling. It makes installing a plastic bag easier. It prevents a paper bag from falling out. It allows either type of shopping bag to expand with garbage. It also makes removing a plastic bag easier.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A shopping bag holder, comprising:

a pair of end panels for having a shopping bag positioned there between;

a single side panel connected between inner edges of said end panels for supporting an inner side of said shopping bag;

outer edges of said end panels being substantially free of projections to define an open outer side for enabling said shopping bag to expand when filled;

a pair of tabs respectively projecting upward from horizontal top edges of said end panels for securing respective handles of said shopping bag, said horizontal top edges of said end panels defining orthogonal shoulders below said tabs for supporting said handles and preventing said handles from slipping down; a top of said side panel being tilted outward relative to a bottom thereof for leaning said shopping bag inwardly for stability; and a support member extending outward from an outer side of said side panel to prevent said holder from falling over due to the tilt in said side panel.

2. A shopping bag holder, comprising:

a pair of end panels for having a shopping bag positioned there between;

a single side panel connected between inner edges of said end panels for supporting an inner side of said shopping bag;

outer edges of said end panels being substantially free of projections to define an open outer side for enabling said shopping bag to expand when filled;

a bottom panel connected between said end panels for supporting a bottom of said shopping bag;

a pair of semicircular tabs respectively projecting upward from horizontal top edges of said end panels for securing respective handles of said shopping bag, said horizontal top edges of said end panels defining orthogonal shoulders below said tabs for supporting said handles and preventing said handles from slipping down;

a pair of holes respectively arranged in said tabs for enabling fingers to pass under said handles of said shopping bag when lifting said shopping bag;

a pair of gaps respectively arranged at midpoints of said tabs for enabling said fingers to pass upwardly through said tabs;

a top of said side panel being tilted outward relative to a bottom thereof for leaning said shopping bag inwardly for stability; and a support member extending outward from an outer side of said side panel to prevent said holder from falling over due to the tilt in said side panel, said support member having a bottom which is aligned with an inner edge of said bottom panel.

3. The shopping bag holder of claim 2, wherein an outer edge of said bottom panel is tilted upward for supporting said shopping bag in the leaning position.

4. The shopping bag holder of claim 2, wherein said side panel and said bottom panel are tilted about 10 degrees.

5. The shopping bag holder of claim 2, further including a raised lip along said outer edge of said bottom panel for securing said shopping bag.

6. The shopping bag holder of claim 2, further including a carrying handle attached to said top of said side panel.

7. A shopping bag holder, comprising:

a pair of end panels for having a shopping bag positioned there between;

a single side panel connected between inner edges of said end panels for supporting an inner side of said shopping bag;

outer edges of said end panels being substantially free of projections to define an open outer side for enabling said shopping bag to expand when filled;

a bottom panel connected between said end panels for supporting a bottom of said shopping bag;

a pair of semi-circular tabs respectively projecting upward from top edges of said end panels for securing respective handles of said shopping bag, horizontal top edges of said end panels defining orthogonal shoulders below said tabs for supporting said handles and preventing said handles from slipping down;

a pair of holes respectively arranged in said tabs for enabling fingers to pass under said handles of said shopping bag when lifting said shopping bag;

a pair of gaps respectively arranged at midpoints of said tabs for enabling said fingers to pass upwardly through said tabs;

a top of said side panel being tilted outward relative to a bottom thereof for leaning said shopping bag inwardly for stability;

an outer edge of said bottom panel being tilted upward for supporting said shopping bag in the leaning position;

a raised lip along said outer edge of said bottom panel for securing said shopping bag; and a support member extending outward from an outer side of said side panel to prevent said holder from falling over due to the tilt in said side panel, said support member having a bottom which is aligned with an inner edge of said bottom panel.

8. The shopping bag holder of claim 7, wherein said side panel and said bottom panel are tilted about 10 degrees.

9. The shopping bag holder of claim 7, further including a carrying handle attached to said top of said side panel.

* * * * *